US008686653B2

(12) United States Patent
Gao

(10) Patent No.: US 8,686,653 B2
(45) Date of Patent: Apr. 1, 2014

(54) LED BACKLIGHT DRIVING METHOD, LIQUID CRYSTAL DISPLAY DEVICE AND LED BACKLIGHT DRIVING CIRCUIT

(75) Inventor: Xinming Gao, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 137 days.

(21) Appl. No.: 13/320,253

(22) PCT Filed: Sep. 7, 2011

(86) PCT No.: PCT/CN2011/079445

§ 371 (c)(1),
(2), (4) Date: Nov. 11, 2011

(87) PCT Pub. No.: WO2013/023395

PCT Pub. Date: Feb. 21, 2013

(65) Prior Publication Data

US 2013/0057166 A1 Mar. 7, 2013

(30) Foreign Application Priority Data

Aug. 18, 2011 (CN) ..... 2011 1 0237519

(51) Int. Cl.
*H05B 37/00* (2006.01)
*H05B 39/00* (2006.01)
*H05B 41/00* (2006.01)

(52) U.S. Cl.
USPC ..... 315/192; 315/185 R; 315/193; 315/291; 315/308

(58) Field of Classification Search
USPC ..... 315/185 R, 186, 191–193
See application file for complete search history.

(56) References Cited

U.S. PATENT DOCUMENTS

| | | | | |
|---|---|---|---|---|
| 2009/0187925 | A1* | 7/2009 | Hu et al. | 719/327 |
| 2009/0261743 | A1* | 10/2009 | Chen et al. | 315/192 |
| 2011/0109245 | A1 | 5/2011 | Lin et al. | |
| 2011/0227497 | A1* | 9/2011 | Hu et al. | 315/224 |
| 2012/0153846 | A1* | 6/2012 | Li et al. | 315/186 |

FOREIGN PATENT DOCUMENTS

| | | | |
|---|---|---|---|
| CN | 1822084 | A | 8/2006 |
| CN | 101426313 | A | 5/2009 |
| CN | 101916547 | A | 12/2010 |
| CN | 201667742 | U | 12/2010 |

(Continued)

OTHER PUBLICATIONS

Li Jun, the International Searching Authority written comments, May. 2012, CN.

(Continued)

*Primary Examiner* — Anh Tran
(74) *Attorney, Agent, or Firm* — IPro, Inc.; Na Xu

(57) ABSTRACT

The present invention discloses a LED backlight driving method, a LCD device and a LED backlight driving circuit, wherein the LED backlight driving method comprises the following steps: regulating the current of each LED string so that the voltages of all LED strings are equal; and regulating the duty cycle of the current of the corresponding LED string so that the effective value of the current of each LED string meets the preset requirement of brightness. The present invention solves the problem of consumption caused by voltage difference by regulating the current through the current regulation module to ensure that the voltages of all the LED strings are equal, and ensures the brightness consistency by regulating the duty cycle through the duty-cycle regulation module so that the effective value of the currents of all the LED strings are equal.

15 Claims, 4 Drawing Sheets

(56) References Cited

FOREIGN PATENT DOCUMENTS

| | | | |
|---|---|---|---|
| CN | 101990715 | A | 3/2011 |
| CN | 102026442 | A | 4/2011 |
| CN | 102123548 | A | 7/2011 |
| CN | 102137535 | A | 7/2011 |
| JP | 2010015728 | A | 1/2010 |
| KR | 10-2011-0071429 | | 6/2011 |

OTHER PUBLICATIONS

Peng Hailiang, the first office action, Jun. 2012, CN.
Peng Hailiang, the third office action, May, 2013, CN.

* cited by examiner

LED BACKLIGHT DRIVING METHOD, LIQUID CRYSTAL DISPLAY DEVICE AND LED BACKLIGHT DRIVING CIRCUIT

TECHNICAL FIELD

The present invention relates to the field of liquid crystal displays (LCDs), particularly to a LED backlight driving method, a LCD device and a LED backlight driving circuit.

BACKGROUND

The existing LED driver of the LCD device using the light-emitting diode (LED) as a backlight is shown in FIG. 1. The backlight driver comprises a light bar, wherein said light bar is provided with multiple LED strings which are in parallel connection; each LED string comprises multiple LED lights which are in series connection; one end of each LED string is connected with the forward voltage Vin, and the other end of each LED string is respectively connected to a constant current controller. The LED driver can monitor the voltage of each LED string in real time, feed back the minimum voltage to the power input, so as to regulate the value of the forward voltage Vin to ensure that the forward voltage Vin can meet the requirement of brightness of the minimum-voltage LED string. This way the LED input voltage is optimized. Meanwhile, in order to ensure the consistency of the LED brightness, the same current and duty driver are used by the constant-current control circuit to control different LED strings, as shown in FIG. 2. This ensures that the effective value of the currents of all LED strings are equal, so as to ensure the consistency of the LED brightness. In the embodiment, because the voltages of different LED strings are different, the difference will be added to the constant-current control circuit, causing consumption. Thus, the temperature of the constant-current control circuit is increased, and the efficiency of the power supply is reduced.

SUMMARY

The aim of the present invention is to provide a LED backlight driving method, a LCD device and a LED backlight driving circuit thereof for compensating the LED voltage difference on the premise of ensuring brightness.

The purpose of the present invention is achieved by the following technical schemes.

A LED backlight driving method comprises the following steps.

A: Regulating the current of each LED string so that the voltages of all LED strings are equal; and B: Regulating the duty cycle of the current of the corresponding LED string so that the effective value of the current of each LED string meets the preset requirement of brightness.

Preferably, said step A comprises the following steps: detecting the voltage of the minimum-voltage LED string, and regulating the current of each LED string so that the voltage of each LED string is equal to the aforementioned voltage. Lower power and reduced energy consumption can be obtained by the method.

Preferably, the duty cycle of the current of said LED string in step B is less than 80%, and a wider range of regulation can be obtained within the range.

Preferably, said step A comprises the following steps: detecting the voltage of the maximum-voltage LED string, and regulating the current of each LED string so that the voltage of each LED string is equal to the aforementioned voltage. Higher brightness can be obtained by the method.

Preferably, said step A comprises the following steps: detecting the average voltage of each LED string, and regulating the current of each LED string so that the voltage of each LED string is equal to the aforementioned average voltage. A wider range of regulation can be obtained by the method by using the average voltage as a reference.

Preferably, the method further comprises step C after step B: feeding back the effective value of the current after flow equalization to the power supply module for supplying power for the LED strings, using the power supply module to regulate the output voltage in real time in accordance with the effective value of the current required by the current brightness, and then repeating step A to step C. The method can ensure that the regulated brightness of LED lights can meet the preset requirement of brightness.

Preferably, the method further comprises step D after step B: judging whether the regulation of the effective value of the current exceeds the regulation range of the duty cycle of LED strings; if exceeded, the LED backlight driving circuit is converted into the constant-current control mode, namely the currents and duty cycles of all LED strings are consistent; if not, return to step A. The method can automatically use the frequently-used constant-current control mode of the prior art when the range of regulation exceeds the range of regulation of duty cycle of the LED strings, to ensure that the LED backlight driving circuit can operate normally.

A LED backlight driving circuit comprises multiple LED strings which are in parallel connection, and a power supply module for supplying power for the LED strings, wherein each LED string comprises multiple LED lights which are in series connection; said LED backlight driving circuit also comprises a current regulation module for regulating the current of each LED string so that the voltages of all LED strings are equal, and a duty-cycle regulation module for regulating the duty cycle of the current of the corresponding LED string so that the effective value of the current of each LED string meets the requirement of brightness.

Preferably, said current regulation module comprises a voltage-detection circuit for detecting the voltage of each LED string, a current-detection circuit, and a control circuit for regulating the current of each LED string by using the reference voltage obtained by the voltage-detection circuit as a reference. This is one embodiment of current regulation module.

A LCD device, wherein said LCD device comprises the aforementioned LED backlight driving circuit.

The present invention reduces the voltage Vf of the single LED light by reducing the current If of the single LED light, and reduces the voltages Vfs of the LED strings by reducing the current of the LED strings with high voltages Vfs; so that the LED strings with high voltages Vfs are matched with the LED strings with low voltages Vfs; the LED voltages of different LED strings are matched; the voltage difference is reduced; the voltage added to the constant current MOSFET is reduced; the consumption is reduced and the efficiency is increased; the effective value of the currents of different LED strings are equalized to ensure the consistency of the LED brightness.

Wherein: 1, LED string; 2, current regulation module; 21, voltage-detection circuit; 22, current-detection circuit; 23, control circuit; 3, duty-cycle regulation module.

DETAILED DESCRIPTION

The present invention will further be described in detail in accordance with the figures and the preferred embodiments.

The design of the LED backlight driving method of the present invention is as follows.

By analyzing the relationship between the voltage Vf of the single LED and the current If of the LED, it is known that the smaller the current If flowing through the LED is, the smaller the voltage Vf of the single LED is. The voltage Vf can be reduced by reducing the LED current If; the voltages Vfs of the LED strings 1 with high voltages Vfs can be reduced by reducing the currents of the LED strings 1, so that the LED strings 1 with high voltages Vfs are matched with the LED strings 1 with low voltages Vfs; the voltage difference ΔVfs of different LED strings 1 is reduced; the voltage added to the constant current MOSFET is reduced; the consumption is reduced and the efficiency is increased.

Figure 1:
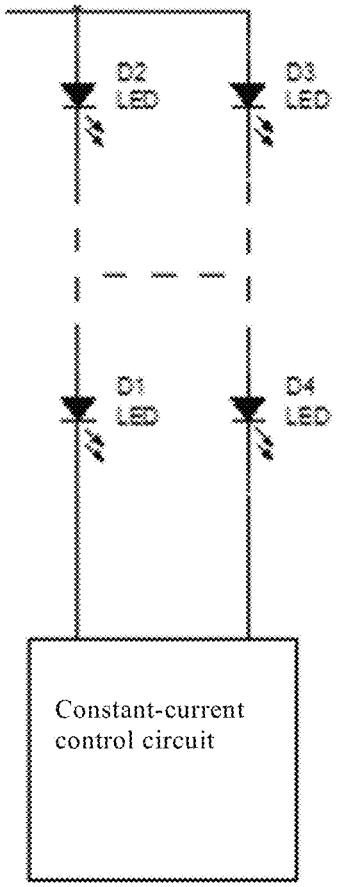
FIG. 1 is the schematic diagram of the LED backlight driving method of the prior art.
Figure 2:
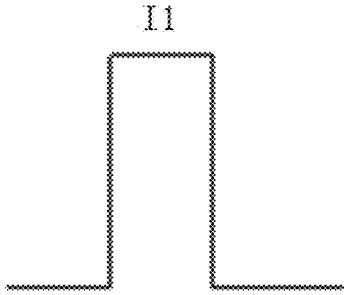
FIG. 2 is the schematic diagram of the waveform of the current of the LED backlight driver of the prior art.
Figure 3:
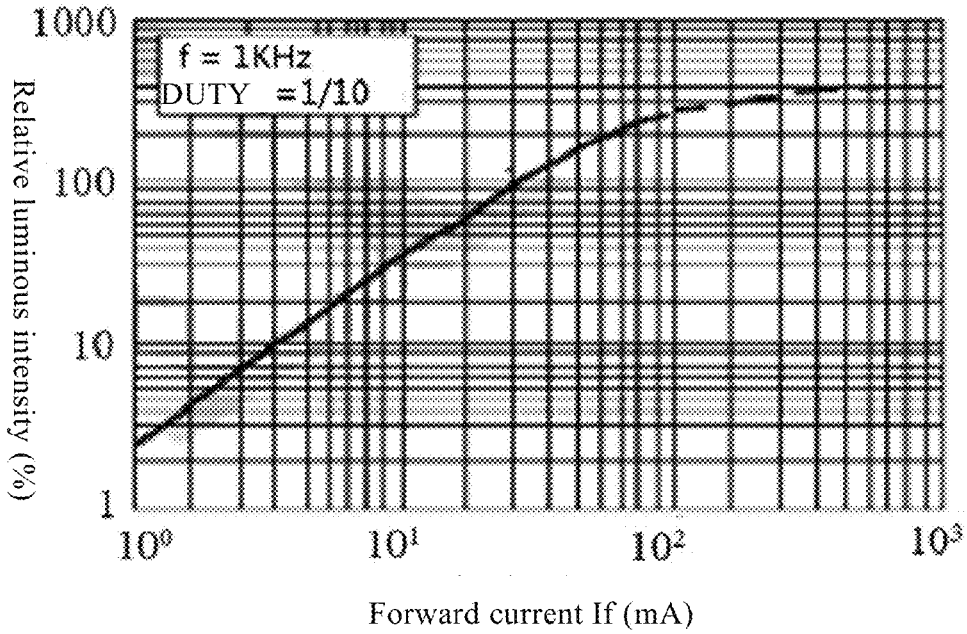
FIG. 3 is the diagram of relation between the voltage Vf of the single LED and the current If of the LED of the present invention.
Figure 4:
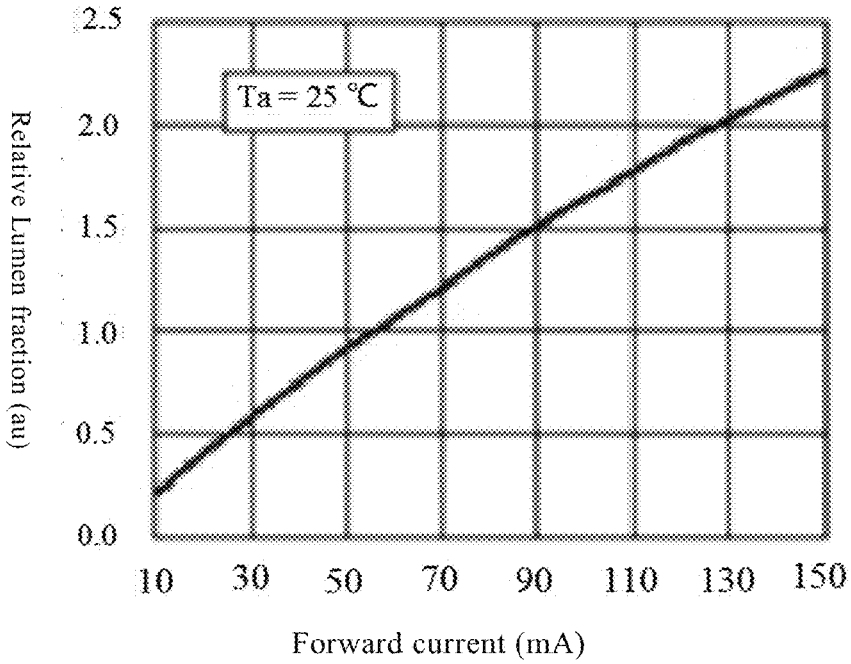
FIG. 4 is the diagram of relation between the LED lumen and the current If of the present invention.

As shown in FIG. 3 and FIG. 4, the relationship between the LED relative luminous intensity and the lumen and the current If is shown in FIG. 3 and FIG. 4. The larger the forward current is, the larger the relative luminous intensity thereof is, and the larger the lumen is; the smaller the forward current is, the smaller the relative luminous intensity thereof is, and the smaller the lumen is. Because the voltages Vfs of different LED strings are different, the difference will be added to the constant current MOSFET; the voltage of the single LED is reduced by reducing the currents of the LED strings 1 with high voltages Vfs, so that the voltages Vfs of different LED strings are close; the voltage difference ΔVfs is reduced, and then the voltage added to the constant current MOSFET is reduced. But because the LED current is reduced, the lumen is reduced under the condition of the same duty cycle. Thus, the effective value of the current and the lumen can be increased by increasing the duty cycle. Therefore, although the currents of all the LED strings 1 are different, the effective value of the current of all the LED strings 1 can be equalized by regulating the duty cycle, so as to obtain the same brightness. The design of the present invention can be preferably used when voltage difference of the voltage Vfs of the LED strings 1 is small.

Figure 5:
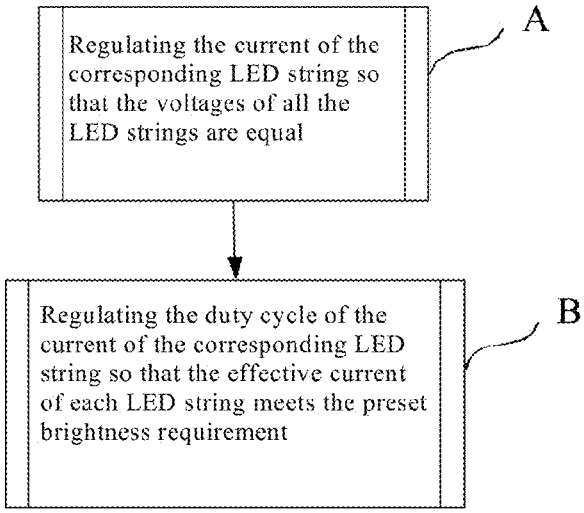
FIG. 5 is the flowchart of the LED driving method of one embodiment of the present invention.

In accordance with the aforementioned principle, as shown in FIG. 5, the LED backlight driving method shown in the embodiment comprises the following steps.

A: Regulating the current of each LED string 1 so that the voltages of all LED strings 1 are equal; and B: Regulating the duty cycle of the current of the corresponding LED string 1 so that the effective value of the current of each LED string 1 meets the preset requirement of brightness.

The LED driving method of the present invention will further be described in detail in accordance the embodiments.

Embodiment 1

Do step A first: detecting the voltage of the minimum-voltage LED string 1 by using the minimum voltage as a reference, and regulating the current of each LED string 1 so that the voltage of each LED string 1 is equal to the aforementioned voltage. Then, do step B: regulating the duty cycle of the current of the corresponding LED string 1 so that the effective value of the current of each LED string 1 meets the preset requirement of brightness. The duty cycle of the current of each said LED string 1 in the method is preferably less than 80%, so that the wider range of regulation can be guaranteed. Lower power consumption can be obtained by using the minimum voltage of the LED string 1 as a reference.

In order to prevent the phenomenon that the LED brightness can not meet the requirement when the duty cycle is set to the maximum, the method further comprises step C after step B: feeding back the effective value of the current after flow equalization to the power supply module for supplying power for the LED strings 1, using the power supply module to regulate the output voltage in real time in accordance with the effective value of the current required by the current brightness, and then repeating the step A to step C.

In order that the LED backlight driving circuit can normally operate in the condition that the range of regulation of the effective value of the current exceeds the range of regulation of the duty cycle of the LED strings 1, the method further comprises step D after step B: judging whether the range of regulation of the effective value of the current exceeds the range of regulation of the duty cycle of the LED strings 1; if exceeded, the LED backlight driving circuit is converted into the constant-current control mode, namely the currents and duty cycles of all the LED strings 1 are consistent; if not, return to step A.

Embodiment 2

Similarly, do step A first. Said step A comprises the following steps: detecting the voltage of each maximum-voltage LED string 1, and regulating the current of each LED string 1 so that the voltage of each LED string 1 is equal to the aforementioned voltage. Then, do step B: regulating the duty cycle of the current of the corresponding LED string 1 so that the effective value of the current of each LED string 1 meets the preset requirement of brightness. The embodiment uses the value of the maximum voltage of the LED strings 1 as a reference.

Similarly, in order to ensure that the LED brightness meets the requirement, the method further comprises step C after step B: feeding back the effective value of the current after flow equalization to the power supply module for supplying power for the LED strings 1, using the power supply module to regulate the output voltage in real time in accordance with the effective value of the current required by the current brightness, and then repeating the step A to step C.

In order that the LED backlight driving circuit can operate normally when the range of regulation of the effective value of the current exceeds the range of regulation of the duty cycle of the LED strings 1, the method further comprises step D after step B: judging whether the range of regulation of the effective value of the current exceeds the range of regulation of the duty cycle of the LED strings 1; if exceeded, the LED backlight driving circuit is converted into the constant-current control mode, namely the currents and duty cycles of all LED strings 1 are consistent; if not, return to step A.

Embodiment 3

Similarly, do step A first. Said step A comprises the following steps: detecting and calculating the average voltage of all the LED strings 1, and regulating the current of each LED string 1 so that the voltage of each LED string 1 is equal to the aforementioned average voltage. Then, do step B: regulating the duty cycle of the current of the corresponding LED string 1 so that the effective value of the current of each LED string 1 meets the preset requirement of brightness. The embodiment uses the average voltage of the LED strings 1 as a reference, so as to obtain a wider range of regulation.

Similarly, in order to ensure that the LED brightness meets the requirement, the method further comprises step C after step B: feeding back the effective value of the current after flow equalization to the power supply module for supplying power for the LED strings 1, using the power supply module to regulate the output voltage in real time in accordance with the effective value of the current required by the current brightness, and then repeating the step A to step C.

In order that the LED backlight driving circuit can operate normally when the range of regulation of the effective value of the current exceeds the range of regulation of the duty cycle of the LED strings 1, the method further comprises step D after step B: judging whether the range of regulation of the effective value of the current exceeds the range of regulation of the duty cycle of the LED strings 1; if exceeded, the LED backlight driving circuit is converted into the constant-current control mode, namely the currents and duty cycle of all the LED strings 1 are consistent; if not, return to step A.

Figure 6:
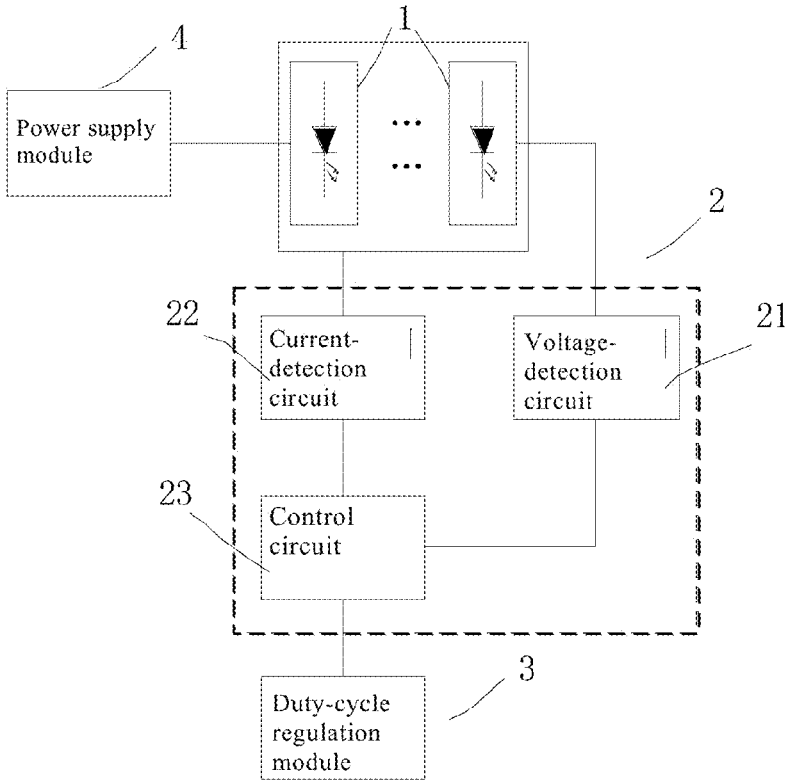
FIG. 6 is the block diagram of the LED driving circuit of one embodiment of the present invention.
Figure 7:
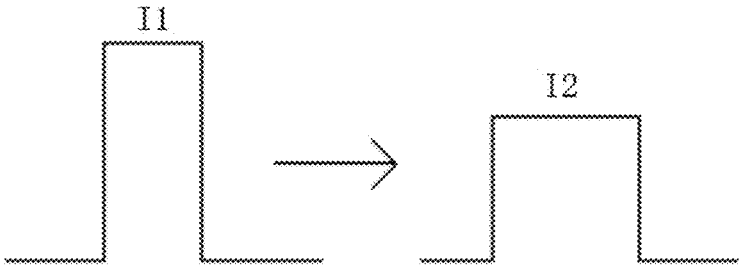
FIG. 7 is the schematic diagram of the waveform of the current of the LED backlight driver of one embodiment of the present invention.

The structure of the LED backlight driving circuit of the LCD device using the aforementioned LED backlight driving method is shown in FIG. 6. The LED backlight driving circuit comprises multiple LED strings 1 which are in parallel connection, and a power supply module for supplying power for the LED strings 1, wherein each LED string comprises multiple LED lights which are in series connection; said LED backlight driving circuit also comprises a current regulation module 2 for regulating the current of each LED string 1 so that the voltages of all LED strings are equal, and a duty-cycle regulation module 3 for regulating the duty cycle of the current of the corresponding LED string 1 so that the effective value of the current of each LED string 1 meets the requirement of brightness. The regulated current waveform is shown in FIG. 7. Preferably, said current regulation module 2 comprises a voltage-detection circuit 21 for detecting the voltage of each LED string 1, a current-detection circuit 22, and a control circuit 23 for regulating the current of each LED string 1 by using the reference voltage obtained by the voltage-detection circuit as a reference.

The present invention is described in detail in accordance with the above contents with the specific preferred embodiments. However, this invention is not limited to the specific embodiments. For the ordinary technical personnel of the technical field of the present invention, on the premise of keeping the conception of the present invention, the technical personnel can also make simple deductions or replacements, and all of which should be considered to belong to the protection scope of the present invention.

I claim:

1. A LED backlight driving method, comprising the following steps:

A: regulating a current of each LED string so that voltages of all the LED strings are equal;

B: regulating a duty cycle of the current of the corresponding LED string so that a effective value of the current of each LED string meets a preset requirement of brightness;

wherein the method further comprises step C after said step B: feeding back the effective value of the current after flow equalization to a power supply module for supplying power for the LED strings, using the power supply module to regulate an output voltage in real time in accordance with the effective value of the current required by a current brightness, and then repeating the step A to step C.

2. The LED backlight driving method of claim 1, wherein said step A comprises the following steps: detecting a voltage of the minimum-voltage LED string, and regulating the current of each LED string so that a voltage of each LED string is equal to the voltage of the minimum-voltage LED string.

3. The LED backlight driving method of claim 2, wherein the duty cycle of the current of each said LED string in said step B is less than 80%.

4. The LED backlight driving method of claim 1, wherein said step A comprises the following steps: detecting a voltage of the maximum-voltage LED string, and regulating the current of each LED string so that a voltage of each LED string is equal to the voltage of the maximum-voltage LED string.

5. The LED backlight driving method of claim 1, wherein said step A comprises the following steps: detecting a average voltage of all the LED strings, and regulating the current of each LED string so that a voltage of each LED string is equal to the average voltage of all the LED strings.

6. A LED backlight driving method, comprising the following steps:

A: regulating a current of each LED string so that voltages of all the LED strings are equal;

B: regulating a duty cycle of the current of the corresponding LED string so that a effective value of the current of each LED string meets a preset requirement of brightness;

wherein the method further comprises step D after said step B: judging whether a range of regulation of the effective value of the current exceeds a range of regulation of the duty cycle of the LED strings; if exceeded, an LED backlight driving circuit is converted into the constant-current control mode, namely the currents and duty cycle of all the LED strings are consistent; if not, return to step A.

7. The LED backlight driving method of claim 6, wherein said step A comprises the following steps: detecting a voltage of the minimum-voltage LED string, and regulating the current of each LED string so that a voltage of each LED string is equal to the voltage of the minimum-voltage LED string.

8. The LED backlight driving method of claim 2, wherein the duty cycle of the current of each said LED string in said step B is less than 80%.

9. The LED backlight driving method of claim 6, wherein said step A comprises the following steps: detecting a voltage of the maximum-voltage LED string, and regulating the current of each LED string so that a voltage of each LED string is equal to the voltage of the maximum-voltage LED string.

10. The LED backlight driving method of claim 6, wherein said step A comprises the following steps: detecting a average voltage of all the LED strings, and regulating the current of each LED string so that a voltage of each LED string is equal to the average voltage of all the LED strings.

11. The LED backlight driving method of claim 6, wherein the method further comprises step C after said step B: feeding back the effective value of the current after flow equalization to a power supply module for supplying power for the LED strings, using the power supply module to regulate an output voltage in real time in accordance with the effective value of the current required by a current brightness, and then repeating the step A to step C.

12. The LED backlight driving method of claim 7, wherein the method further comprises step C after said step B: feeding back the effective value of the current after flow equalization to a power supply module for supplying power for the LED strings, using the power supply module to regulate an output voltage in real time in accordance with the effective value of the current required by a current brightness, and then repeating the step A to step C.

13. The LED backlight driving method of claim 8, wherein the method further comprises step C after said step B: feeding back the effective value of the current after flow equalization to a power supply module for supplying power for the LED strings, using the power supply module to regulate an output voltage in real time in accordance with the effective value of the current required by a current brightness, and then repeating the step A to step C.

14. The LED backlight driving method of claim 9, wherein the method further comprises step C after said step B: feeding back the effective value of the current after flow equalization to a power supply module for supplying power for the LED strings, using the power supply module to regulate an output voltage in real time in accordance with the effective value of the current required by a current brightness, and then repeating the step A to step C.

15. The LED backlight driving method of claim 10, wherein the method further comprises step C after said step B: feeding back the effective value of the current after flow equalization to a power supply module for supplying power for the LED strings, using the power supply module to regulate an output voltage in real time in accordance with the effective value of the current required by a current brightness, and then repeating the step A to step C.

* * * * *